US006276697B1

(12) United States Patent
Lin

(10) Patent No.: US 6,276,697 B1
(45) Date of Patent: Aug. 21, 2001

(54) ADJUSTABLE ROLLER SKATE

(76) Inventor: Henkel Lin, No. 13, Lane 130, Kung-An Rd. Houli Hsiang, Taichung Hsien (TW)

( * ) Notice: Subject to any disclaimer, the term of this patent is extended or adjusted under 35 U.S.C. 154(b) by 0 days.

(21) Appl. No.: 09/628,821

(22) Filed: Jul. 31, 2000

(51) Int. Cl.[7] ..... A63C 1/22
(52) U.S. Cl. ..... 280/11.26; 280/11.3
(58) Field of Search ..... 280/11.26, 11.221, 280/11.231, 11.27, 11.3, 11.31; 36/97; 441/70

(56) References Cited

U.S. PATENT DOCUMENTS 3,360,812 * 1/1968 Kluge ..... 441/70
5,484,149 * 1/1996 Lee ..... 280/11.26
5,645,288 * 7/1997 Lu ..... 280/11.26
5,794,362 * 8/1998 Polk, III et al. ..... 36/97
5,842,293 * 12/1998 Young ..... 36/97
5,904,359 * 5/1999 Caeran et al. ..... 280/11.15
5,913,526 * 6/1999 Olson et al. ..... 280/11.22
6,045,144 * 4/2000 Wong ..... 280/11.26
6,224,070 * 5/2001 Carpenter et al. ..... 280/14.2

* cited by examiner

*Primary Examiner*—Brian L. Johnson
*Assistant Examiner*—G B Klebe
(74) *Attorney, Agent, or Firm*—Hedman & Constigan P.C.

(57) ABSTRACT

The roller skate has a cover having a toe cup and a separate heel cup. A boot is placed in the cover and made up of a toe portion and a heel portion connected together by a stretchable belt. A front part and a rear part of an adjustment mechanism are respectively fixed to the toe cup and the heel cup of the cover, which engage with each other by a direction-bar-and-groove engagement, and are slidable and fixable with each other.

3 Claims, 4 Drawing Sheets

ADJUSTABLE ROLLER SKATE

BACKGROUND OF THE INVENTION

1. Field of the Invention

The invention relates to an adjustable roller skate, especially to a roller skate the length of which is stretchable and therefore being suitable to more users.

2. Description of Related Art

Roller-skating has recently undergone a resurgence in popularity. One kind of roller skate has a row of wheels, usually four, rotatably installed on a frame securely fixed to a sole of a boot. However, sizes of this kind of roller skate are fixed. Therefore, if children, often growing fast, want to keep skating, new skates have to be bought to ensure their feet are not harmed through too-small boots, as well as enabling the children to skate to their maximum ability. Furthermore, it is unusual for two members of a family to have the same size feet and so there is limited use of the skates.

SUMMARY OF THE INVENTION

The main object of the invention is to provide an adjustable roller skate a length of which is stretchable to meet the requirement of child user whose feet grow and therefore change fast or different users whose feet are of different length.

Other objects, advantages and novel features of the invention will become more apparent from the following detailed description when taken in conjunction with the accompanying drawings.

DETAILED DESCRIPTION OF THE PREFERRED EMBODIMENT

Figure 1:
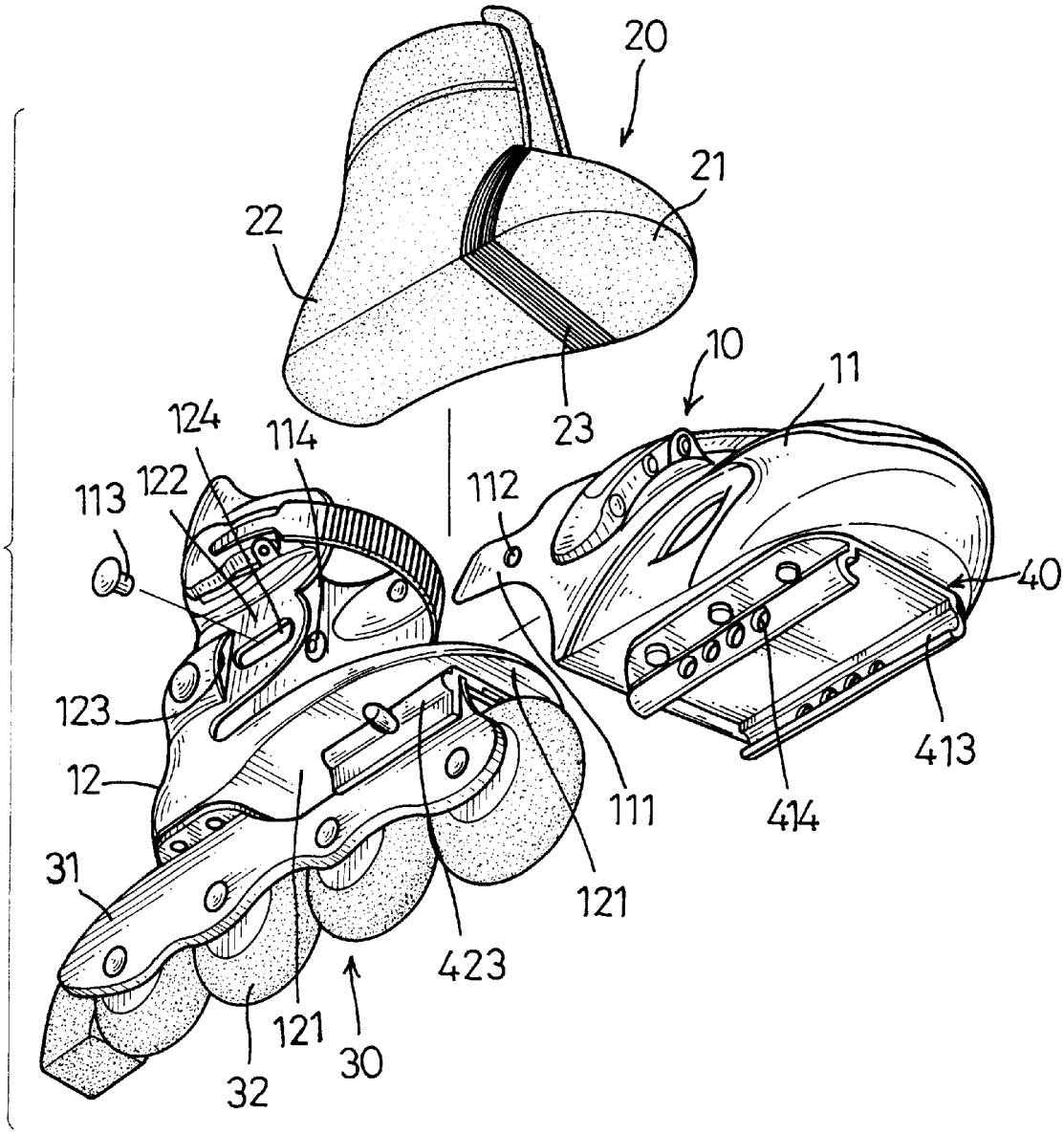
FIG. 1 is an exploded perspective view of the invention.

As shown in FIG. 1, the invention, an adjustable roller skate, consists of a cover (10) made of relatively hard material, a boot (20) placed in the cover (10) and made of relatively soft material, a wheel mechanism (30), and an adjusting mechanism (40).

The boot (20) has a toe portion (21) and a heel portion (22) both of which are connected together by a stretchable belt (23). The belt (23) could be an elastic cord and is used in order that the boot (20) can expand or contract to receive feet of different sizes.

The cover (10) includes a toe cup (11) and a heel cup (12). A pair of strips (111) (in FIG. 1, only one is able to be seen) extend rearward respectively from two sides of the toe cup (11). A hole (112) is defined in a root of each strip (111).

The heel cup (12) has a sole (121) and a rear wall (122) formed on the sole (121) and extending substantially upward. A pair of slits (123) are defined in the rear wall (122) in which the pair of strips (111) is able to be respectively received. A pair of slots (124) are defined in the rear wall (122) being substantially parallel to the sole (121) and being in front of the slits (123). In FIG. 1, only one of the slits (123) and one of the slots (124) can be seen.

The wheel mechanism (30) consists of a row of wheels (32) of a certain quantity, in the shown embodiment of the invention, four, rotatably installed on a frame (31) securely fixed to the sole (121) of the roller skate.

Figure 2:
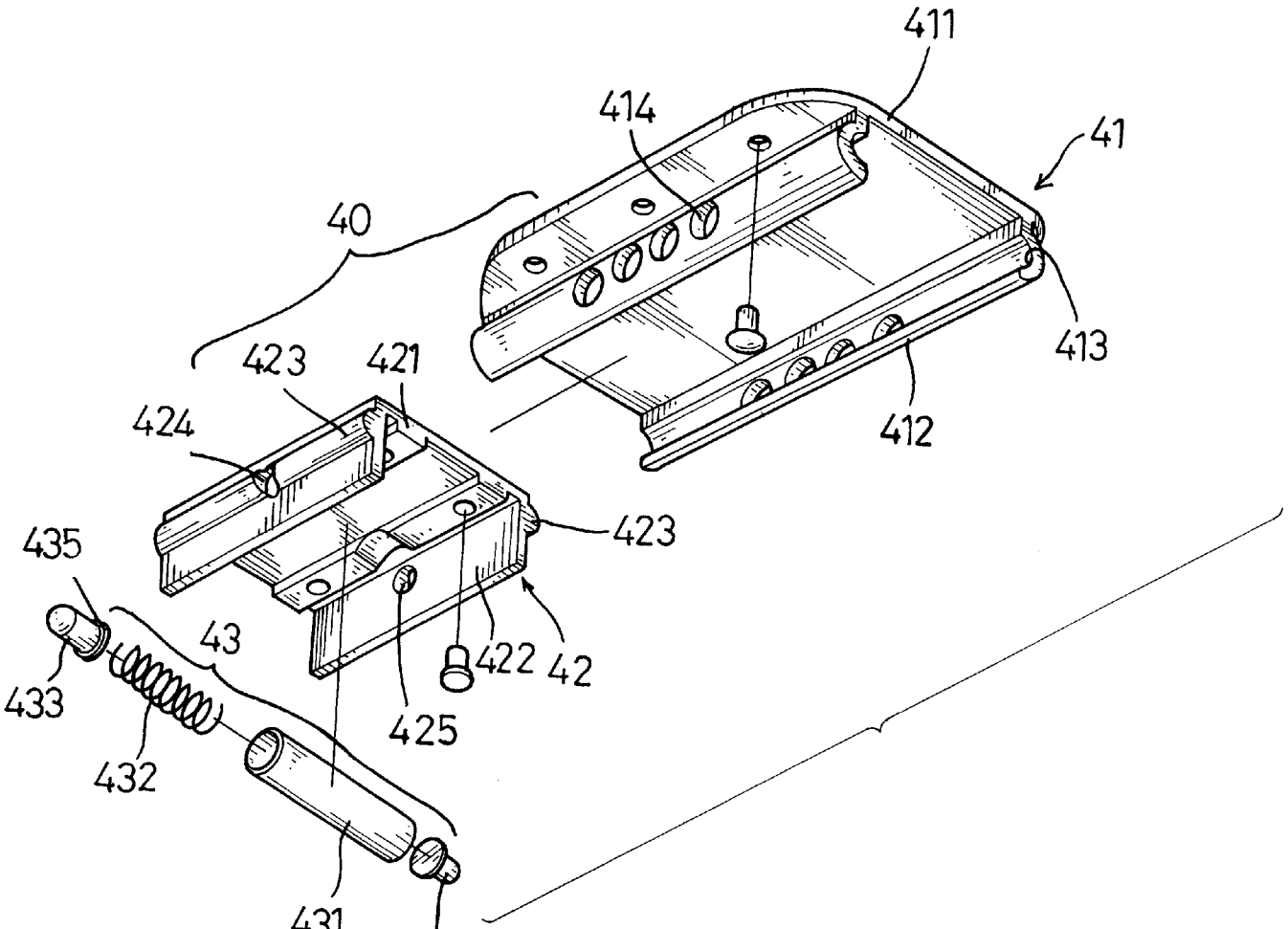
FIG. 2 is an exploded perspective view of the fixing means of the invention.
Figure 3:
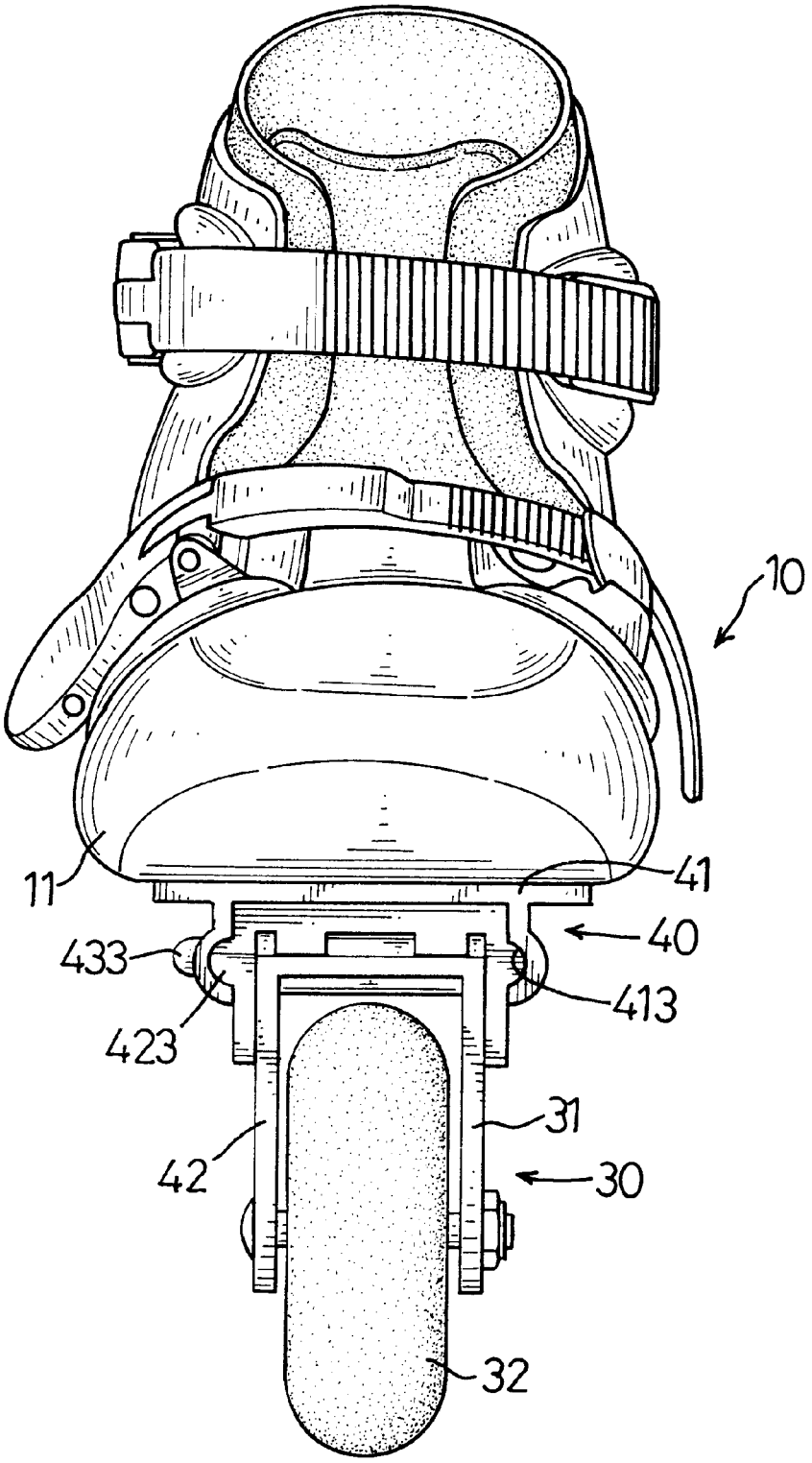
FIG. 3 is a schematic front view of the invention.

With reference to FIGS. 1 and 2, the adjusting mechanism (40) has a front part (41) fixed to a sole of the toe cup (11), and a rear part (42) fixed to the sole (121) of the heel cup (12). The front part (41) is a board (411) with a pair of parallel rails (412) formed thereon. Each rail (412) has an inner face defining a groove (413) having a semi-circular cross sectional profile. A row of openings (414) of a certain quantity, in the shown embodiment, four, are defined in at least one of the two rails (412). The rear part (42) also has a board (421) with a pair of plates (422) formed thereon and extending downward with respect thereto. A direction bar (423), which has a semi-circular cross section being able to match the groove (413), is formed on an outer face of each plate (422). The rear part (42) of the adjusting mechanism (40) is able to be inserted into the front part (41), with the direction bars (423) being slidable in the grooves (413), as shown in FIG. 3. A side opening (424) is defined in one of the plates (422) facing the at least one rail (412) in which the row of openings (414) is defined. A recess (425) is defined in the other of the plates (422) and opposite the side opening (424).

Figure 4:
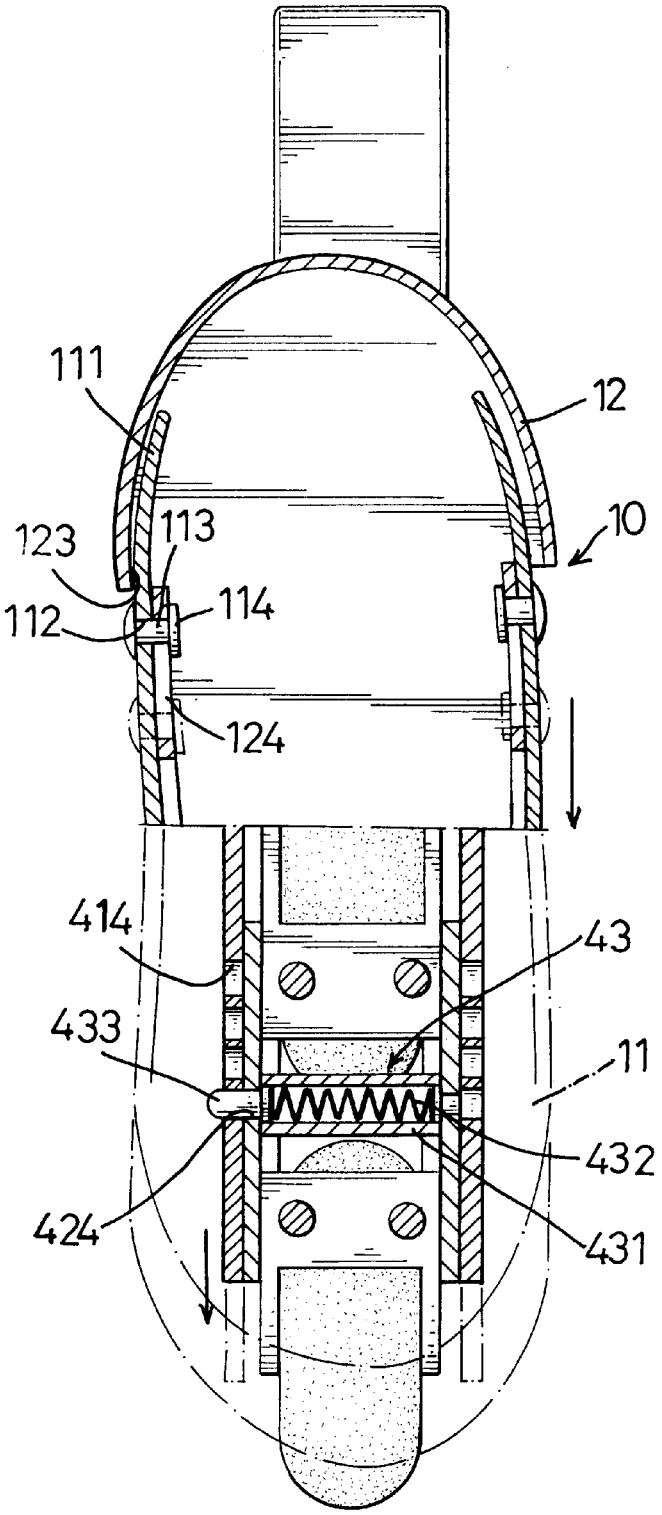
FIG. 4 is a top cross sectional view of the invention.

Continuing to take reference to FIG. 2 and together with FIG. 4, it is illustrated that the adjusting mechanism (40) has a positioning means (43) including a tube (431) with a first end and a second end, a spring (432) contained in the tube (431), a finger (433) received in and protruding from the first end of the tube (431) and being pressed by the spring (432), and a tail (434) formed on the second end of the tube (431).

In assembly, as shown in FIGS. 3 and 4, the tail (434) is first put into the recess (425) and then the finger (433) is pushed back into the tube (431) against the spring (432). When the tube (431) is put in alignment with the side opening (424), the finger (433) is pushed out by the spring (432) to enter the opening (424) until a flange (435) of the finger (434) is blocked by a periphery of the side opening (424), as more clearly shown in FIG. 4. Then the rear part (42) is able to be inserted into the front part (41). At first, the finger (433) will meet a top end of one the rails (412) of the same side. The finger (433) is pressed down in order for the rear part (42) to go further into the front part (41) until the finger (433) meets and enters a first one of the row of the openings (414) under the pressing of the spring (432). At this time, the rear part (42) is fixed with respect to the front part (41). Then, the pair of the strips (111) are able to be respectively inserted into the pair of the slits (123) until each hole (112) falls within a scope of each of the pair of the slots (124). A male button (113) is then able to be inserted through each of the holes (112) and the slots (124) and respectively engages with a female button (114) to sandwich the pair of strips (111) with respect to the rear wall (122) of the heel cup (12).

In use, if the length of the roller skate needs to be changed the finger (433) is pushed inward and then the front part (41) is moved with respect to the rear part (42) of the adjustment mechanism (40). Then the finger (433) will engage with another one of the openings (414). This operation can be repeated until a suitable position is found between the rear part (42) and the front part (41).

From above description, it is understood that with the roller skate of the invention, a length thereof is conveniently adjustable to meet the requirement of child user whose feet are growing or different users whose feet are of different length.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the inven-tion to the full extent indicated by the broad general meaning of the terms in which the appended claims are expressed.

What is claimed is:

1. An adjustable roller skate having a cover (10), a boot (20) placed in the cover (10), a wheel mechanism (30) having a row of wheels (32) and installed on a frame (31) securely fixed to a sole (121) of the cover (10), and an adjusting mechanism (40), wherein the improvements comprise:

the cover (10) having a toe cup (11) and a heel cup (12), a pair of strips (111) respectively formed on two sides of the toe cup (11) and extending rearward, a hole (112) defined in a root of each strip (111), the heel cup (12) having a sole (121) and a rear wall (122) formed on the sole (121) and extending substantially upward, a pair of slits (123) defined in the rear wall (122) in which the pair of strips (111) is able to be respectively received, a pair of slots (124) defined in the rear wall (122) being substantially parallel to the sole (121) and being in front of the slits (123);

the adjusting mechanism (40) having a front part (41) fixed to a sole of the toe cup (11), and a rear part (42) fixed to the sole (121) of the heel cup (12), the front part (41) and the rear part (42) being movable with respect to each other and securable to adjust the length of the roller skate; and, the boot (20) having a toe portion (21) and a heel portion (22) both of which are connected together by a stretchable belt (23).

2. The adjustable roller skate as claimed in claim 1, wherein:

the front part (41) is a board (411) with a pair of parallel rails (412) formed thereon, each rail (412) having an inner direction groove (413), and a plurality of openings (414) being defined in at least one of the two rails;

the rear part (42) has a board (421) with a pair of plates (422) formed thereon and extending downward with respect thereto, a direction bar (423) matching the groove (413) and formed on an outer face of each plate (422), the rear part (42) of the adjusting mechanism (40) being inserted into the front part (41), with the direction bars (423) being slidable in the grooves (413), a side opening (424) being defined in one of the plates (422) facing the at least one rail (412) in which a row of openings (414) is defined, a recess (425) is defined in the other of the plates (422) and opposite the side opening (424); and, the adjusting mechanism (40) has a positioning means (43) including a tube (431) with a first end and a second end, a spring (432) contained in the tube (431), a finger (433) contained in the tube (431) and being extendable from the first end of the tube (431) and a tail (434) formed on the second end of the tube (431).

3. The adjustable roller skate as claimed in claim 1, wherein the strips (111) are able to be respectively inserted into the slits (123) until each hole (112) falls within a scope of each of the pair of the slots (124), and then a male button (113) is inserted through each of the holes (112) and the slots (124) and respectively engages with a female button (114) to sandwich the strips (111) with respect to the rear wall (122) of the heel cup (12).

* * * * *